US006764168B1

(12) United States Patent
Meinhold et al.

(10) Patent No.: US 6,764,168 B1
(45) Date of Patent: Jul. 20, 2004

(54) SENSOR FOR DETECTING DROPLET CHARACTERISTICS

(75) Inventors: Henner W. Meinhold, Fremont, CA (US); Mark L. Rea, Hayward, CA (US); Sachin M. Chinchwadkar, Milpitas, CA (US); Fred J. Chetcuti, Milbrae, CA (US); John S. Drewery, Alameda, CA (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 10/087,539

(22) Filed: Mar. 1, 2002

(51) Int. Cl.[7] ..... B41J 2/125
(52) U.S. Cl. ..... 347/81
(58) Field of Search ..... 347/19, 73, 78, 347/79, 81

(56) References Cited

U.S. PATENT DOCUMENTS 3,852,768 A * 12/1974 Carmichael et al. ..... 347/81
4,922,268 A * 5/1990 Osborne ..... 347/19
5,705,935 A * 1/1998 Nishimura ..... 324/64
6,436,843 B1 8/2002 Meinhold et al.
6,617,079 B1 * 9/2003 Pillion et al. ..... 430/3
2003/0011663 A1 * 1/2003 Sarmast ..... 347/81

OTHER PUBLICATIONS

IJT print head, Ink Jet Technology Inc., webpage [online] [retrieved on Feb. 8, 2002]. Retrieved from the Internet: URL:http://www.inkjet–tech.com.html.

Charge Sensitive Preamplifier A250, State–Of–the–Art, webpage [online] [retrieved on Feb. 6, 2002]. Retrieved from the internet: URL:http://www.amptek.com/a250.html.

* cited by examiner

*Primary Examiner*—Anh T. N. Vo
(74) *Attorney, Agent, or Firm*—Okamoto & Benedicto LLP

(57) ABSTRACT

In one embodiment, a sensor includes two plates that form a capacitor. A droplet passing between the plates changes the capacitance of the sensor, thereby triggering an amplifier coupled to the sensor to generate an output signal. The output signal is indicative of droplet characteristics and may be used to calibrate a mechanism that dispensed the droplet.

21 Claims, 8 Drawing Sheets

SENSOR FOR DETECTING DROPLET CHARACTERISTICS

BACKGROUND OF THE INVENTION

1. Field Of The Invention

The present invention relates generally to sensors, and more particularly but not exclusively to sensors employed in integrated circuit fabrication.

2. Description Of The Background Art

Fabrication of an integrated circuit (IC) typically requires deposition of one or more layers of material onto a wafer. The deposited material, which is also referred to as "thin film" or simply "film", is preferably deposited such that it has uniform thickness across the wafer or localized regions of the wafer. As is well know, the more uniform the film thickness, the better. Thus, a technique for facilitating dispensing of uniform amounts of material on a wafer is generally desirable.

SUMMARY

The present invention relates to methods and apparatus for detecting droplet characteristics. Embodiments of the present invention may be used in various applications including, without limitation, in dispensing uniform amounts of materials on a wafer and other workpieces.

In one embodiment, a sensor includes two plates that form a capacitor. A droplet passing between the plates changes the capacitance of the sensor, thereby triggering an amplifier coupled to the sensor to generate an output signal. The output signal is indicative of droplet characteristics and may be used to calibrate a mechanism that dispensed the droplet.

These and other features and advantages of the present invention will be readily apparent to persons of ordinary skill in the art upon reading the entirety of this disclosure, which includes the accompanying drawings and claims.

The use of the same reference label in different drawings indicates the same or like components.

DETAILED DESCRIPTION

In the present disclosure, numerous specific details are provided, such as examples of apparatus, circuits, components, and methods to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Embodiments of the present invention will be described in the context of an integrated circuit (IC) manufacturing equipment. It should be understood, however, that the present invention is not so limited and may be employed in other applications requiring sensing of droplet characteristics.

Figure 1:
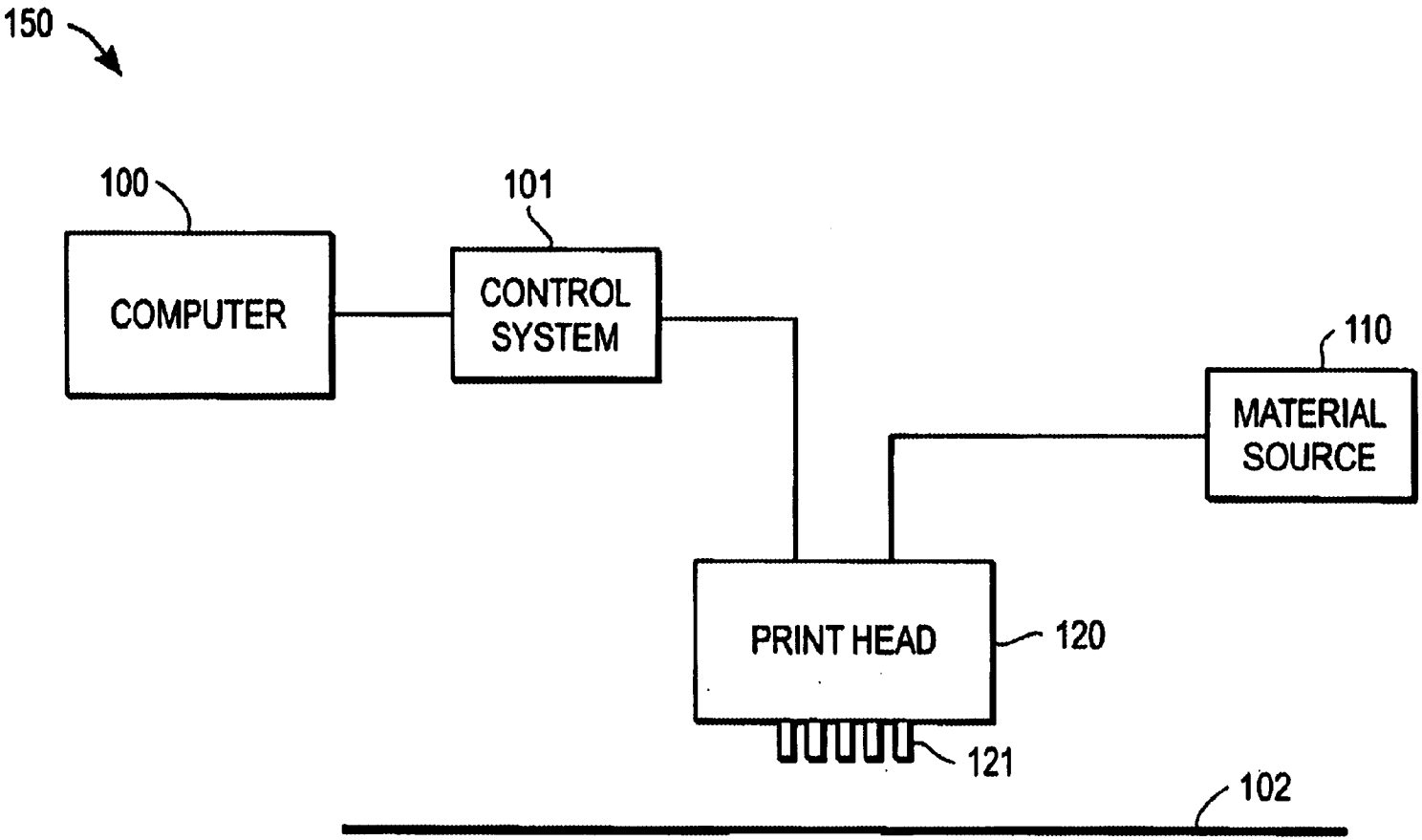
FIG. 1 shows a schematic diagram of an integrated circuit manufacturing equipment that may benefit from embodiments of the present invention.

Referring now to FIG. 1, there is shown a schematic diagram of an IC manufacturing equipment 150 that may benefit from embodiments of the present invention. Other IC manufacturing equipments that may also employ embodiments of the present invention are disclosed in co-pending and commonly assigned U.S. application Ser. No. 09/823,721, now U.S. Pat. No. 6,436,843, filed on Mar. 30, 2001, by Henner Meinhold, Fred J. Chetcuti, and Judy Huang. The just mentioned US Application is incorporated herein by reference in its entirely.

In equipment 150, an ink-jet print head 120 includes nozzles 121 for dispensing materials on a wafer 102. An example of a print head that may be employed includes that of the type available from Ink Jet Technologies, Inc. of San Jose, Calif. (URL:<http://www.inkjet-tech.com>). It is to be noted that embodiments of the present invention may also be used with other droplet dispensing mechanisms.

Material to be deposited on wafer 102 is contained in material source 110 and dispensed through nozzles 121. The material to be deposited depends on the fabrication process. Examples of materials that may be dispensed using print head 120 include, without limitation, low dielectric constant materials, photoresists, developers, slurries, cleaning liquids, and silica-based solutions such as spin-on-glass.

As shown in FIG. 1, print head 120 may be controlled by a computer 100 via a control system 101. Control system 101 may include data acquisition and control devices for monitoring and controlling print head 120. Control system 101 may also include devices for monitoring and controlling other components of equipment 150 such as material source 110 and one or more transport mechanisms (not shown) for moving print head 120. To deposit material on wafer 102, droplets of the material are dispensed through nozzles 121 while print head 120 is moved across the wafer.

Figure 2A:
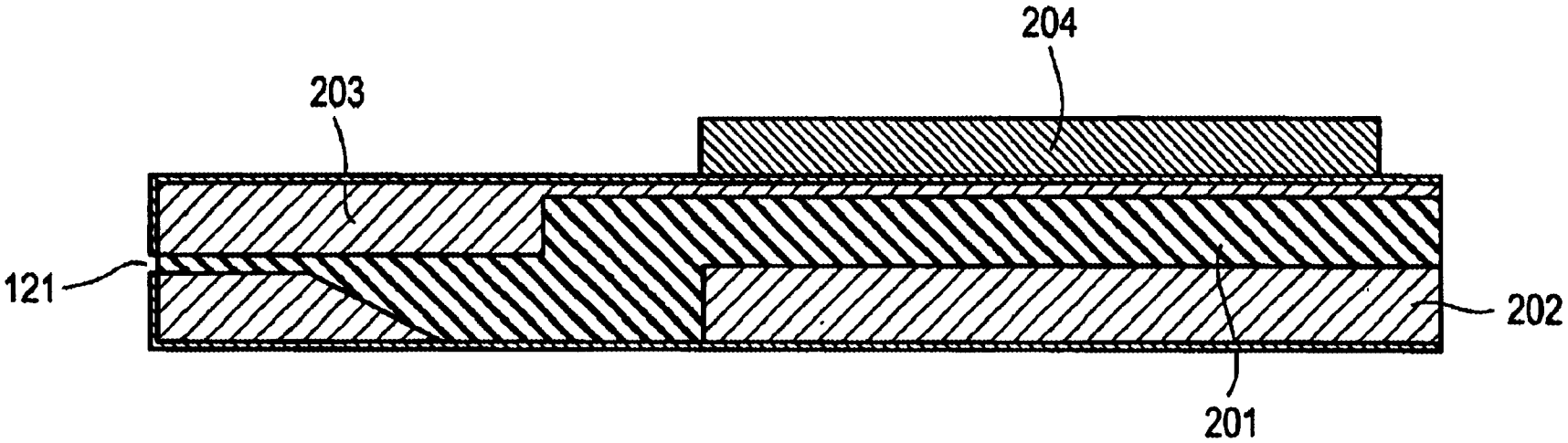
FIG. 2A (PRIOR ART)
FIGS. 2A, 2B, and 2C schematically illustrate portions of a print head that may be employed in the equipment of FIG. 1.
Figure 2B:
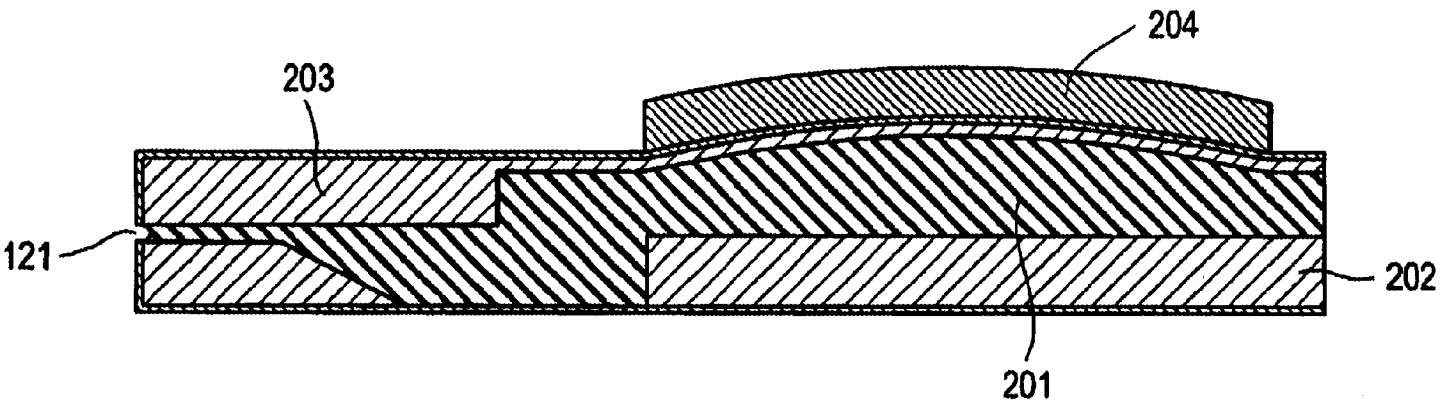
FIG. 2B (PRIOR ART)
Figure 2C:
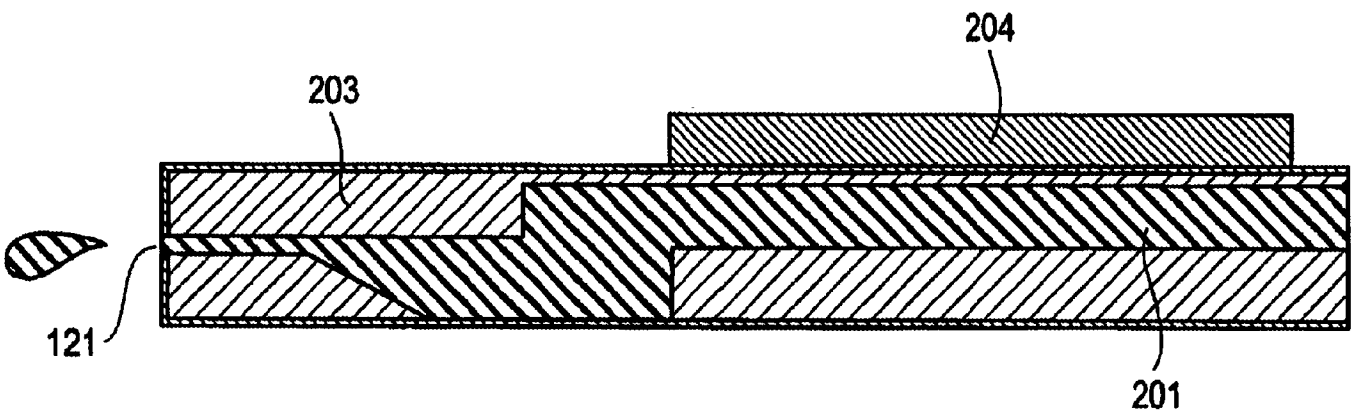
FIG. 2C (PRIOR ART)

FIGS. 2A–2C schematically illustrate portions of a print head 120 that may be employed in equipment 150. The example print head 120 shown in FIGS. 2A–2C is a print head from Ink Jet Technologies, Inc. It is to be understood, however, that embodiments of the present invention are not limited to sensing characteristics of droplets dispensed from such an ink-jet print head or other droplet dispensing mechanisms. In the example of FIGS. 2A–2C, a nozzle 121 is coupled to a chamber 201, which in turn receives material from a reservoir such as material source 110. Chamber 201 is surrounded by a ceramic chamber piece 203 and ceramic nozzle piece 202. A piezoceramic actuator 204 is disposed adjacent chamber 201 as shown in FIG. 2A. Referring to FIG. 2B, applying a low voltage on actuator 204 causes actuator 204 to contract, thereby making chamber 201 expand and draw material from the reservoir. Thereafter, as illustrated in FIG. 2C, applying a high voltage on actuator 204 causes actuator 204 to relax. The resulting pressure surge drives material from chamber 201 and out of nozzle 121.

To obtain uniform film thickness, a multi-nozzle mechanism such as a print head should uniformly dispense droplets onto a wafer. However, due to variations in the manufacture of nozzles and actuators, not all nozzles will dispense droplets the same way. That is, the mass of each droplet (also referred to as "drop mass") and the speed at which a droplet is ejected (also referred to as "drop velocity") will vary from nozzle to nozzle. For example, one nozzle may dispense droplets of a certain mass at a certain drop velocity, whereas another nozzle may dispense droplets of another mass at another drop velocity. To compensate for variations in drop mass and drop velocity, embodiments of the present invention advantageously employ a sensor for detecting droplet characteristics. Information obtained from the sensor may be used to calibrate each nozzle so that all nozzles dispense droplets having relatively the same characteristics.

Figure 3A:
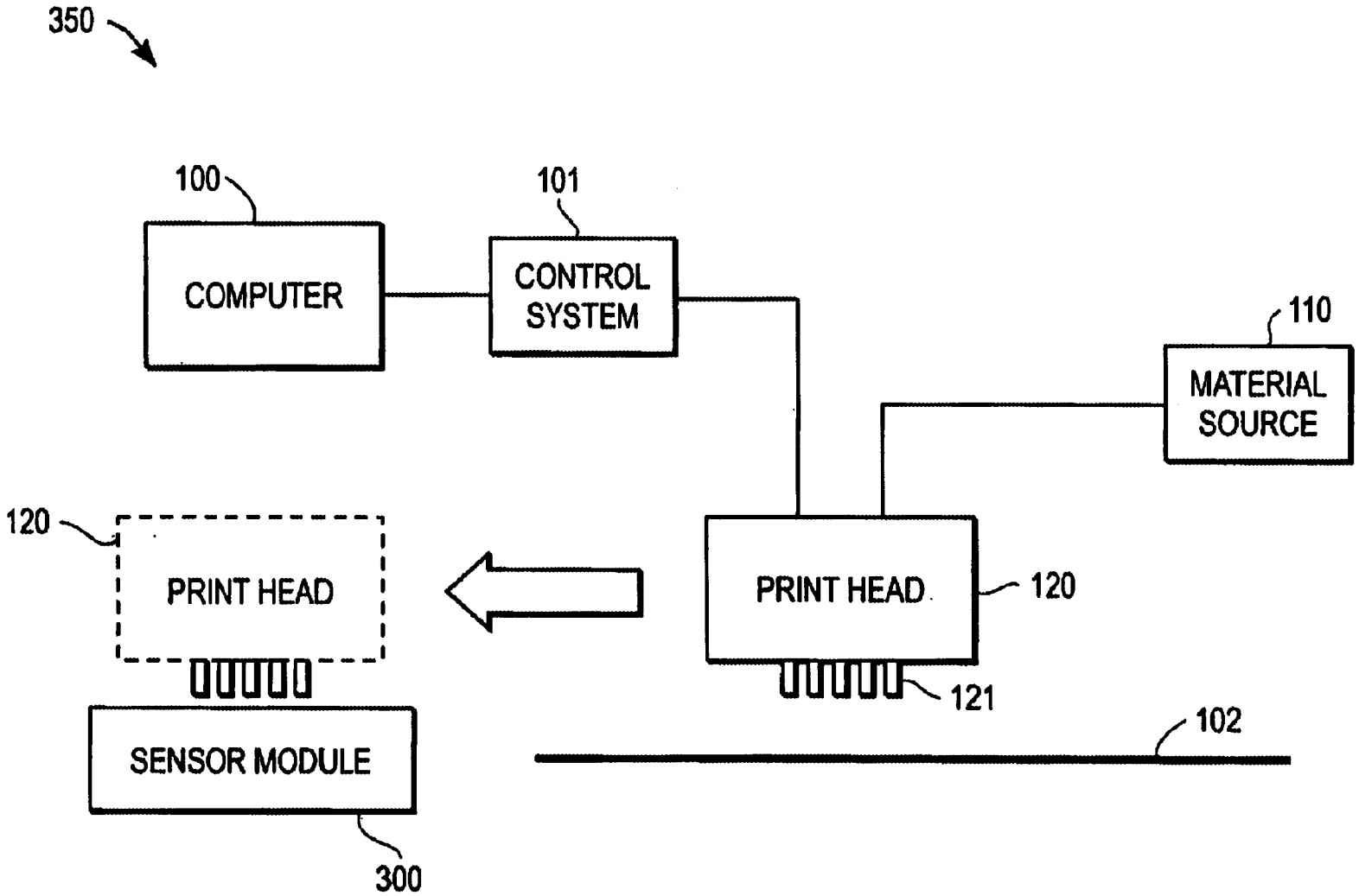
FIG. 3A shows a schematic diagram of an integrated circuit manufacturing equipment in accordance with an embodiment of the present invention.

Referring now to FIG. 3A, there is shown an IC manufacturing equipment 350 in accordance with an embodiment of the present invention. Equipment 350 is similar to equipment 150 shown in FIG. 1 except for the addition of a sensor module 300. Sensor module 300 allows nozzles 121 to be calibrated to achieve relatively uniform drop mass.

Sensor module 300 may also be used to calibrate nozzles 121 so that they dispense droplets at a relatively uniform drop velocity.

In one embodiment, sensor module 300 is placed in a location reachable by print head 120. For example, sensor module 300 may be in a maintenance station adjacent to a chamber where wafer 102 is processed. Prior to dispensing material on wafer 102, print head 120 may be positioned over sensor module 300 using a transport mechanism (not shown) such as a motorized single or two-axis stage, for example. A nozzle 121 is then actuated to dispense a droplet through a sensor in sensor module 300, which detects the drop mass. The detected drop mass may be compared to a known good drop mass. The known good drop mass for a particular application may be determined by experimentation, for example. If the drop mass is not within a desired range, the nozzle 121 may be adjusted until it dispenses droplets having the desired mass. For example, if the nozzle 121 employs a piezoceramic actuator, the electrical signal applied on the actuator may be varied to achieve the desired drop mass. The electrical signal needed to be applied on the actuator to dispense droplets having the desired mass may be stored in computer 100, and then used on the nozzle 121 during operation.

Sensor module 300 may also be used to detect drop velocity by measuring the time between dispensing a droplet from a nozzle 121 and detecting the droplet in sensor module 300. This measured time together with the known distance between a nozzle 121 and sensor module 300 may be used to calculate drop velocity. For example, computer 100 may be alerted when nozzle 121 is fired and when the dispensed droplet reaches sensor module 300. Computer 100 may then calculate the drop velocity and compare it to a known good drop velocity. The known good drop velocity for a particular application may be determined by experimentation, for example. If the nozzle 121 employs a piezoceramic actuator, the electrical signal applied on the actuator may be varied to achieve the desired drop velocity. The electrical signal needed to be applied on the actuator to dispense droplets at the desired velocity may be stored in computer 100, and then used on the nozzle 121 during operation.

The just mentioned calibration process may be used for each nozzle 121 so that all nozzles 121 dispense droplets having relatively the same mass, drop velocity, or both. As can be appreciated, this in turn will help improve film thickness uniformity on the wafer.

Figure 3B:
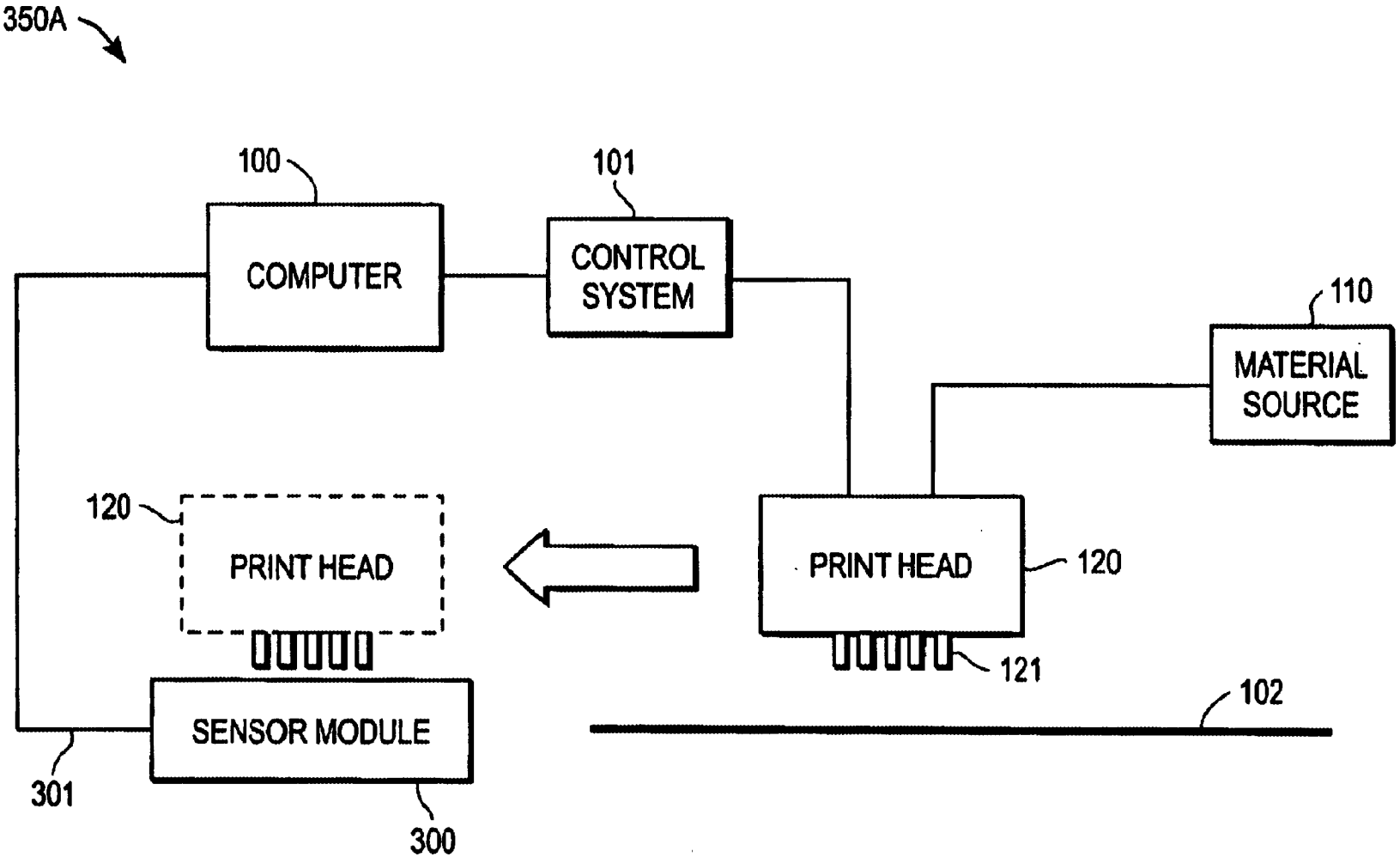
FIG. 3B shows a schematic diagram of an integrated circuit manufacturing equipment in accordance with another embodiment of the present invention.

Referring now to FIG. 3B, there is shown an IC manufacturing equipment 350A in accordance with another embodiment of the present invention. Equipment 350A is similar to equipment 350 shown in FIG. 3A except for the addition of a link 301 coupling sensor module 300 to computer 100. Link 301 allows sensor module 300 to provide feedback signals to computer 100. The feedback signals may include, without limitation, signals indicative of detected drop mass, drop velocity, or both. This helps integrate the calibration process with the deposition process. For example, computer 100 may position print head 120 over sensor module 300, calibrate each nozzle 121 of print head 120, position print head 120 over wafer 102, and then dispense material on wafer 102.

Figure 4:
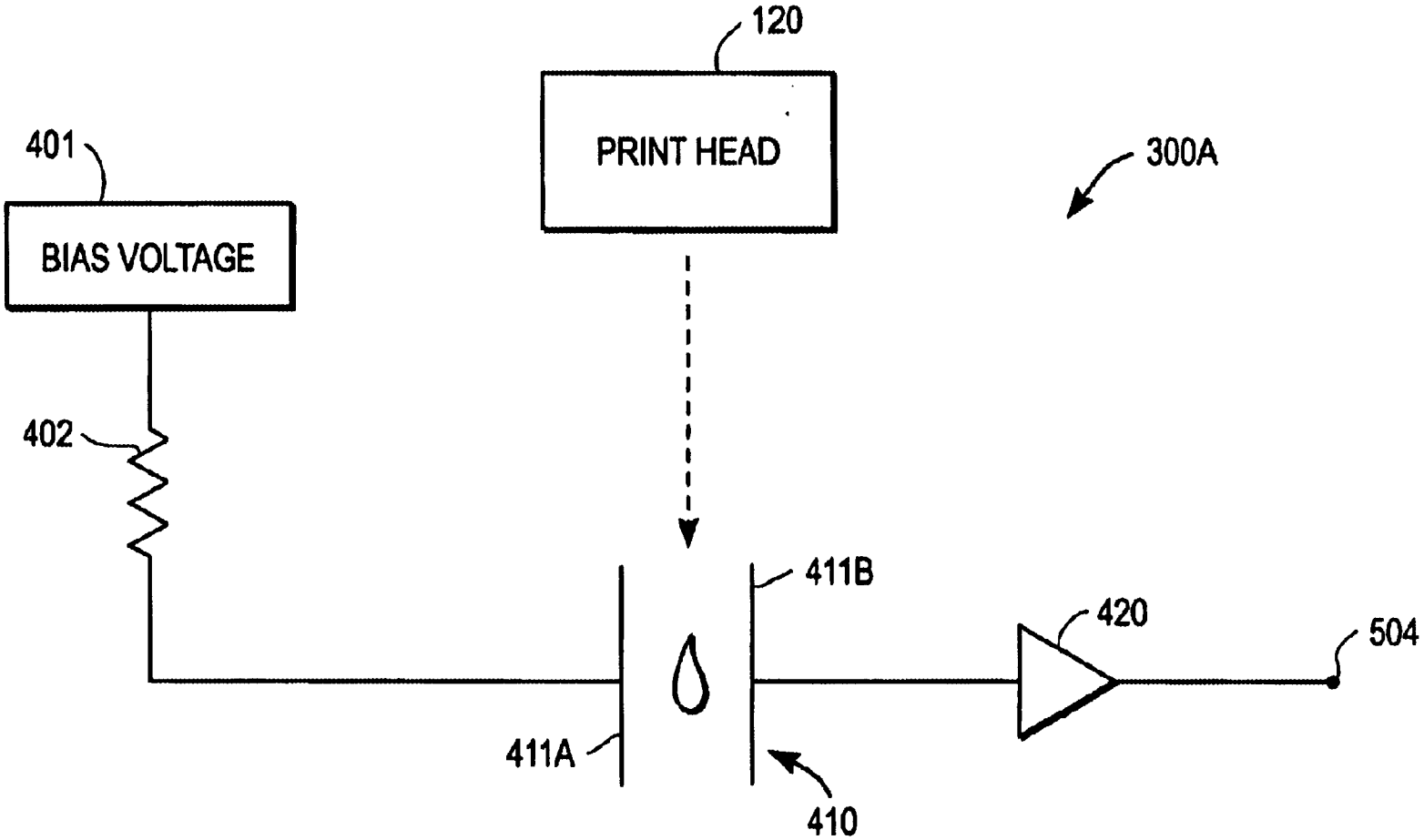
FIG. 4 shows a schematic diagram of a sensor module in accordance with an embodiment of the present invention.

FIG. 4 shows a schematic diagram of a sensor module 300A in accordance with an embodiment of the present invention. Sensor module 300A is a specific embodiment of sensor module 300 shown in FIGS. 3A and 3B. As shown in FIG. 4, sensor module 300A includes a bias voltage 401, a sensor 410, and a charge sensitive amplifier 420. Sensor 410 further includes a plate 411A and a plate 411B that, in effect, form a capacitor. In one embodiment, plates 411 (i.e., 411A, 411B) are thin blades of electrically conductive material. The surfaces of plates 411 may be placed in parallel, with a gap in the order of the distance between nozzles 121 (e.g., ~100 to 1000 microns).

Bias voltage 401 applies a voltage (e.g., ~100 to 1000V DC) on plate 411A through resistor 402. Plate 411B is coupled to amplifier 420.

In one embodiment, plates 411 (i.e., 411A, 411B) are separated by air. Because the dispensed droplets have dielectric constants higher than air (e.g., about 7 to 80, depending on the material), a droplet passing between plates 411 changes the capacitance of sensor 410. The resulting charge on sensor 410 is sensed by amplifier 420, which then generates a corresponding output signal on terminal 504. The signal on terminal 504 may be processed to detect drop mass and drop velocity. For example, the amplitude of the output signal contains information about the relative mass of the just detected droplet, and may thus be used to sense drop mass. As another example, the delay time between the firing of the nozzle 121 and the resulting output signal on output terminal 504 may be used to calculate drop velocity. Thus, the output signal at terminal 504 may be used to calibrate for drop mass, drop velocity, or both.

As mentioned, the output signal at terminal 504 may be used to sense relative drop mass. However, the output signal may also be used to sense absolute drop mass by, for example, performing measurements correlating the amplitude of output signals with actual (i.e., measured with another instrument) droplet mass.

Sensor module 300A provides several advantages. First, because sensor 410 is relatively simple in construction, it does not need a lot of periodic cleaning and maintenance. Second, sensor module 300A may be used not just for calibration but also for testing if a nozzle is functioning. As can be appreciated, both calibration and testing may be performed in-situ. Third, sensor module 300A may be integrated in an automatic feed back system (e.g., see FIG. 3B) to allow for automatic calibration of the nozzles. Fourth, the relatively short measurement time of sensor module 300A allows measurement of relative volume of volatile fluids (e.g., spin-on coating materials) that are ordinarily hard to measure because they readily evaporate when dispensed.

The short measurement time also facilitates collection of large amounts of data from which accurate averages may be extracted.

Figure 5:
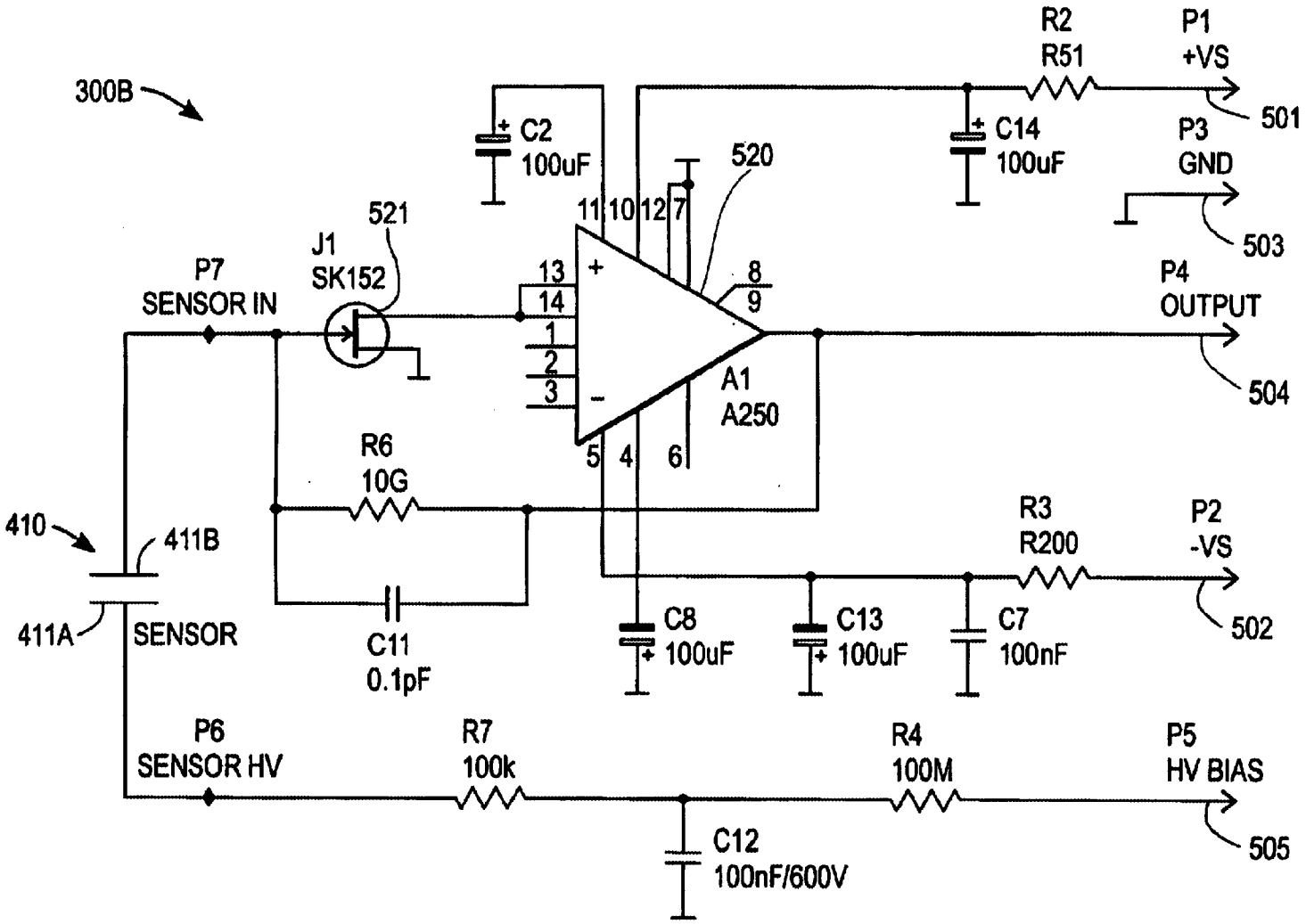
FIG. 5 shows a circuit diagram of a sensor module in accordance with an embodiment of the present invention.

FIG. 5 shows a circuit diagram of a sensor module 300B in accordance with an embodiment of the present invention. Sensor module 300B is a specific embodiment of sensor module 300 shown in FIGS. 3A and 3B. As shown in FIG. 5, sensor module 300B includes a sensor 410 having plates 411A and 411B. In the example of FIG. 5, plates 411 are two parallel thin plates. In one embodiment, plates 411 are fine strips of sheet metal spaced ~300 microns apart and each having a sensing area of about 1.5 mm×2.0 mm. Droplets to be sensed pass through the air gap between plates 411. Plate 411A is coupled to a bias voltage applied on a terminal 505. In one embodiment, the bias voltage is about 200 volts. Plate 411B is coupled to a transistor 521. In one embodiment, transistor 521 is a FET transistor employed to increase the input impedance of a charge sensitive amplifier 520. Amplifier 520 may be of the same type as, for example, the A250 charge sensitive preamplifier available from Amptek, Inc. of Bedford, Mass. (URL:<http://www.amptek.com>).

In FIG. 5, power supplies (not shown) coupled to terminals 501 and 502 provide input power to amplifier 520. A terminal 503 is coupled to a ground reference.

Still referring to FIG. 5, a droplet dispensed through plates 411 changes the capacitance of sensor 410. The resulting charge is compensated for by amplifier 520 through its feedback path to the gate of transistor 521. This results in an output voltage pulse on terminal 504. The output voltage pulse on terminal 504 may then be processed to determine drop mass, drop velocity, or both.

Figure 6A:
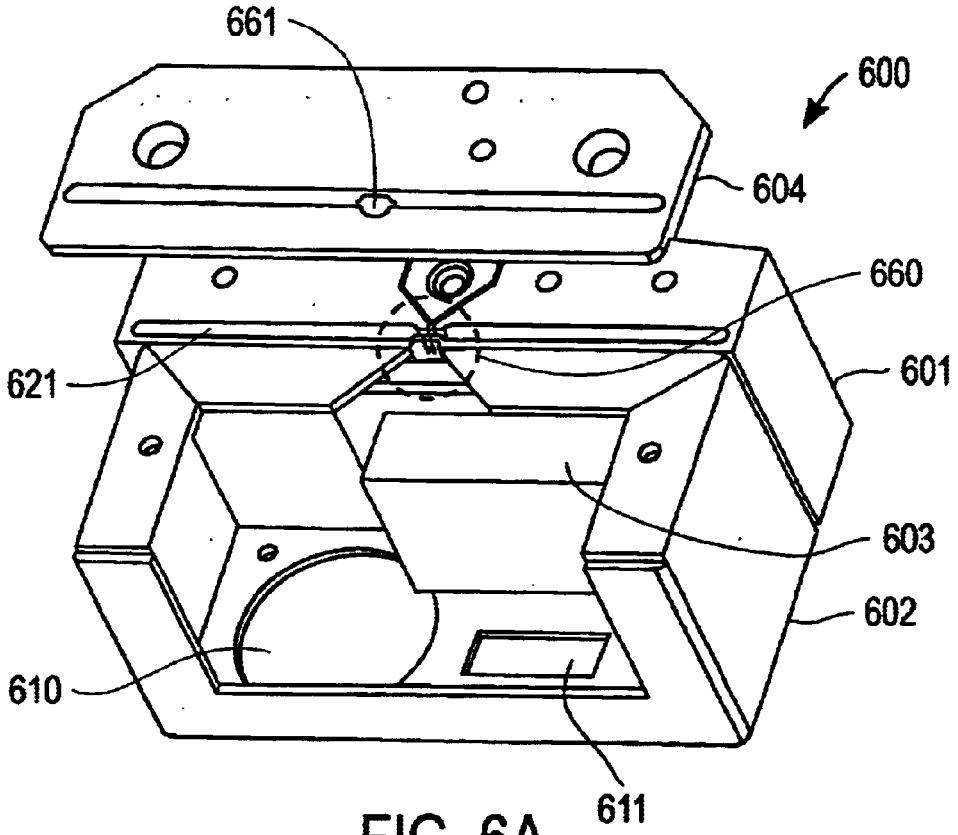
FIG. 6A shows a perspective view of a chassis assembly for a sensor module in accordance with an embodiment of the present invention.

FIG. 6A shows a perspective view of a chassis assembly 600 for a sensor module in accordance with an embodiment of the present invention. Chassis assembly 600 includes a sensor block 601, a housing 602, and a cover plate 604.

Figure 6B:
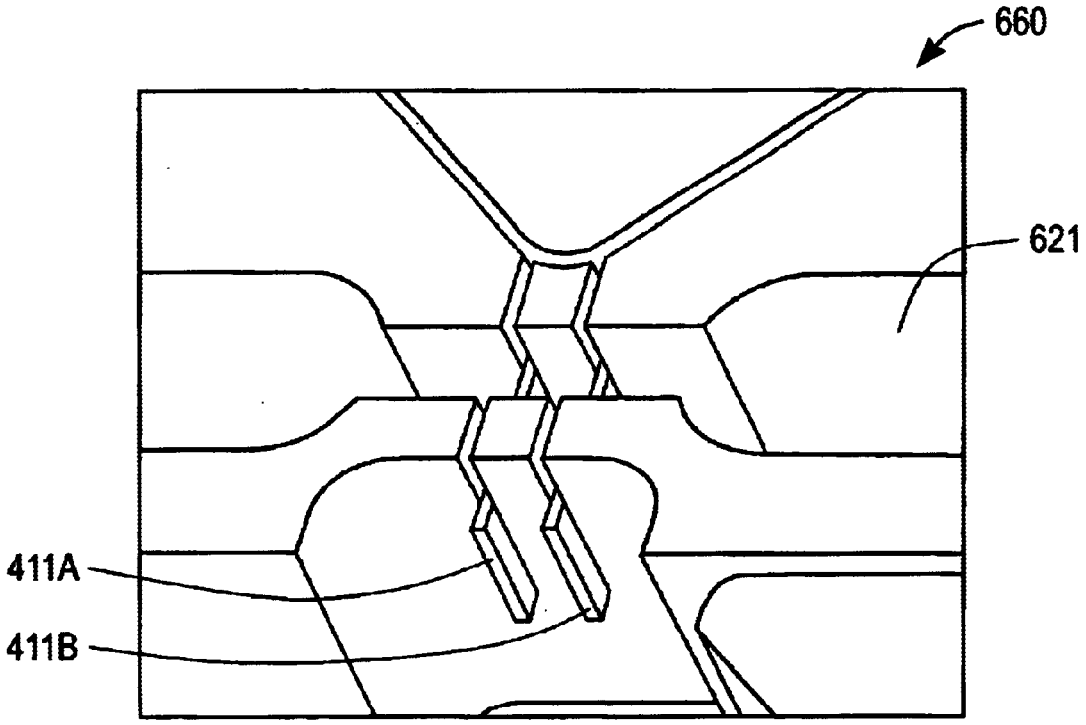
FIG. 6B shows a magnified view of a portion of the chassis assembly of FIG. 6A.

FIG. 6B shows a magnified view of a portion of sensor block 601 denoted as area 660 in FIG. 6A. As shown in FIG. 6B, sensor block 601 includes two parallel grooves where a pair of plates 411 are inserted. Droplets passing between plates 411 fall to the bottom of channel 621. A drain (not shown) at the bottom of channel 621 allows droplets to be flushed out of the sensor module. Sensor block 601 is advantageously of a material that is impervious to the droplets. In one embodiment, sensor block 601 is made of Ertalyte, PET-P material from Quadrant Engineering Plastic Products.

Referring back to FIG. 6A, a cover plate 604 serves as a shield and goes over sensor block 601. A hole 661 in cover plate 604 allows droplets to pass through and go between plates 411. Plates 411 may be soldered to wires coupled to circuitry (e.g., see FIG. 5) inside an electronic enclosure 603. Advantageously, electronic enclosure 603 is shielded to minimize electrical interference to the circuitry. Holes 610 and 611 in housing 602 allow wiring to be coupled to circuitry inside electronic enclosure 603.

Improved techniques for sensing droplet characteristics have been disclosed. While specific embodiments have been provided, it is to be understood that these embodiments are for illustration purposes and not limiting. Many additional embodiments will be apparent to persons of ordinary skill in the art reading this disclosure. Thus, the present invention is limited only by the following claims.

What is claimed is:

1. A system comprising:

an integrated circuit manufacturing equipment;

a print head having a plurality of nozzles, the print head being configured to deposit a material on a wafer in the integrated circuit manufacturing equipment; and a transport mechanism configured to move the print head between a position over the wafer and another position over a sensor module, the sensor module being configured to receive droplets from the nozzles of the print head to allow the nozzles to be calibrated to dispense a substantially same amount of material, the sensor comprising:

a first plate and a second plate forming a capacitor, the first plate and the second plate being disposed to allow the droplet to pass between them; and an amplifier coupled to the first plate, the amplifier configured to generate an output signal indicative of a characteristic of the droplet.

2. The system of claim 1 wherein the sensor module further comprises:

a bias voltage coupled to the second plate; and wherein the amplifier includes a charge sensitive amplifier.

3. The system of claim 2 wherein the sensor module further comprises an input transistor coupled between the amplifier and the first plate.

4. The system of claim 1 wherein the characteristic includes drop mass.

5. The system of claim 1 wherein the characteristic includes drop velocity.

6. The system of claim 1 wherein the print head comprises an ink-jet print head.

7. The system of claim 1 wherein the output signal is employed to calibrate the nozzles to have substantially same drop mass.

8. The system of claim 1 wherein the sensor module is located near a chamber where the wafer is processed to allow calibration of the print head.

9. The system of claim 1 wherein the output signal is provided to a signal processing device.

10. The system of claim 9 wherein the signal processing device includes a computer.

11. A system comprising:

an integrated circuit manufacturing equipment;

dispensing means for dispensing a droplet in the integrated circuit manufacturing equipment, the dispensing means including a plurality of nozzles;

sensor means for detecting the droplet;

circuit means for generating a signal indicative of a characteristic of the droplet; and transport means for moving the dispensing means from a position over a wafer to a position over the sensor means.

12. The system of claim 11 wherein the characteristic includes drop mass.

13. The system of claim 11 wherein the characteristic includes drop velocity.

14. A method of sensing a droplet characteristic, the method comprising:

dispensing a first droplet from a first nozzle of a print head having a plurality of nozzles;

detecting a presence of the first droplet;

generating a first output signal indicative of a first amount of the droplet;

comparing the first amount of the first droplet to a known good amount;

calibrating the first nozzle of the print head based on the comparison of the first amount to the known good amount; and using the print head to deposit a material on a wafer.

15. The method of claim 14 further comprising:

processing the first output signal to sense drop mass, and wherein the first droplet is detected by monitoring for a change in capacitance.

16. The method of claim 14 further comprising:

processing the first output signal to sense drop velocity, and wherein the first droplet is detected by monitoring for a change in capacitance.

17. The method of claim 14 further comprising:

calibrating a second nozzle of the print head to dispense a second amount of droplet that is substantially the same as the known good amount.

18. The method of claim 14 comprising:

prior to using the print head to deposit the material on the wafer:

dispensing a second droplet from a second nozzle of the print head;

detecting a presence of the second droplet;

generating a second output signal indicative of a second amount of the second droplet;

comparing the second amount of the second droplet to the known good amount; and calibrating the second nozzle of the print head based on the comparison of thesecond amount to the known good amount.

19. A system comprising:

a sensor configured to detect a passing material;

an amplifier coupled to the sensor, the amplifier configured to generate an output signal indicative of a characteristic of the material;

a control system configured to generate a tuning signal based on the output signal, the tuning signal being provided to a mechanism that dispensed the material, the mechanism that dispensed the material including a plurality of nozzles; and an integrated circuit manufacturing equipment, the integrated circuit manufacturing equipment being configured to employ the mechanism that dispensed the material to perform deposition on a wafer.

20. The system of claim 19 wherein the output signal is indicative of a mass of the material.

21. The system of claim 19 wherein the output signal is indicative of a drop velocity of the material.

* * * * *